US008308623B2

(12) United States Patent
Nelson et al.

(10) Patent No.: US 8,308,623 B2
(45) Date of Patent: Nov. 13, 2012

(54) APPARATUS FOR ENHANCING A FILTER COMPONENT OF A SMOKING ARTICLE, AND ASSOCIATED METHOD

(75) Inventors: John Larkin Nelson, Lewisville, NC (US); Travis Eugene Howard, Clemmons, NC (US); Vernon Brent Barnes, Advance, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 772 days.

(21) Appl. No.: 12/259,838

(22) Filed: Oct. 28, 2008

(65) Prior Publication Data

US 2010/0101589 A1 Apr. 29, 2010

(51) Int. Cl.
*B31C 99/00* (2009.01)

(52) U.S. Cl. ..... 493/39; 493/4; 493/45; 493/47; 131/84.1

(58) Field of Classification Search ..... 493/4, 39, 493/40, 44–50, 941; 131/84.1
See application file for complete search history.

(56) References Cited

U.S. PATENT DOCUMENTS

| | | | | |
|---|---|---|---|---|
| 3,288,147 | A | 11/1966 | Molins et al. | |
| 3,297,038 | A | 1/1967 | Homburger | |
| 3,308,600 | A | 3/1967 | Erdmann et al. | |
| 3,313,306 | A * | 4/1967 | Berger et al. | 131/342 |
| 3,339,557 | A | 9/1967 | Karalus | |
| 3,339,558 | A | 9/1967 | Waterbury | |
| 3,366,121 | A | 1/1968 | Carty | |
| 3,390,686 | A | 7/1968 | Irby, Jr. et al. | |
| 3,420,242 | A | 1/1969 | Boukair | |
| 3,424,172 | A | 1/1969 | Neurath | |
| 3,428,049 | A | 2/1969 | Leake et al. | |
| 3,508,558 | A | 4/1970 | Seyburn | |
| 3,513,859 | A | 5/1970 | Carty | |
| 3,547,130 | A | 12/1970 | Harlow et al. | |

(Continued)

FOREIGN PATENT DOCUMENTS

WO WO 03/009711 A1 2/2003

(Continued)

OTHER PUBLICATIONS

Borschke, A. J., "Review of Technologies Relating to Menthol Use in Cigarettes", *Rec. Adv. Tob. Sci.*, 1993, pp. 47-70, No. 19.

(Continued)

*Primary Examiner* — Thanh Truong
(74) *Attorney, Agent, or Firm* — Womble Carlyle Sandridge & Rice, LLP

(57) ABSTRACT

An apparatus and method for manufacturing a rod member for a cigarette filter element is provided. Each rod member defines a longitudinal axis and includes a generally longitudinally-extending filter material. A rod-forming unit is configured to form a continuous supply of a filter material into a continuous cylindrical rod member. An object insertion unit is configured to introduce a plurality of objects into engagement with the rod member along the longitudinal axis. A dispensing device is configured to selectively dispense a liquid substance into the filter material, substantially commensurately with the introduction of the plurality of objects into engagement with the rod member, wherein the liquid substance is configured to affect an attribute associated with the objects. A rod-dividing unit is configured to divide the rod member into a plurality of rod portions such that each rod portion includes at least one object and a portion of the liquid substance.

37 Claims, 7 Drawing Sheets

U.S. PATENT DOCUMENTS 3,575,180 A 4/1971 Carty
3,596,665 A 8/1971 Lindgard
3,602,231 A 8/1971 Dock
3,625,228 A 12/1971 Dock
3,635,226 A 1/1972 Horsewell et al.
3,669,128 A 6/1972 Cohen
3,685,521 A 8/1972 Dock
3,797,644 A 3/1974 Shaw
3,853,039 A * 12/1974 Haslam et al. ..... 493/48
3,915,176 A 10/1975 Heitmann et al.
3,916,914 A 11/1975 Brooks et al.
3,972,335 A 8/1976 Tiggelbeck et al.
3,991,773 A 11/1976 Walker
4,033,387 A 7/1977 Nijs et al.
4,046,153 A 9/1977 Kaye
4,082,098 A 4/1978 Owens, Jr.
4,126,141 A 11/1978 Grossman
4,174,719 A 11/1979 Martin
4,280,187 A 7/1981 Reuland et al.
4,281,670 A 8/1981 Heitmann et al.
4,281,671 A 8/1981 Bynre et al.
4,291,713 A 9/1981 Frank
4,474,190 A 10/1984 Brand
4,476,807 A 10/1984 Pryor
4,537,583 A * 8/1985 Pryor ..... 493/42
4,549,875 A 10/1985 Pryor
4,574,816 A 3/1986 Rudszinat
4,677,995 A 7/1987 Kallianos et al.
4,729,391 A 3/1988 Woods et al.
4,736,754 A 4/1988 Heitmann et al.
4,744,932 A * 5/1988 Browne ..... 264/41
4,781,203 A 11/1988 La Hue
4,807,809 A 2/1989 Pryor et al.
4,811,745 A 3/1989 Cohen et al.
4,844,100 A 7/1989 Holznagel
4,848,375 A 7/1989 Patron et al.
4,850,301 A 7/1989 Greene, Jr. et al.
4,862,905 A 9/1989 Green, Jr. et al.
4,865,056 A 9/1989 Tamaoki et al.
4,878,506 A 11/1989 Pinck et al.
4,889,144 A 12/1989 Tateno et al.
4,925,602 A 5/1990 Hill et al.
4,941,486 A 7/1990 Dube et al.
5,012,823 A 5/1991 Keritsis et al.
5,012,829 A 5/1991 Thesing et al.
5,025,814 A 6/1991 Raker
5,060,664 A 10/1991 Siems et al.
5,060,665 A 10/1991 Heitmann
5,156,169 A 10/1992 Holmes et al.
5,191,906 A 3/1993 Myracle, Jr.
5,220,930 A 6/1993 Gentry
5,225,277 A 7/1993 Takegawa
5,271,419 A 12/1993 Arzonico et al.
5,331,981 A 7/1994 Tamaoki et al.
5,387,093 A 2/1995 Takei
5,387,285 A 2/1995 Rivers
5,724,997 A 3/1998 Smith et al.
6,229,115 B1 5/2001 Voss et al.
6,360,751 B1 3/2002 Fagg et al.
6,584,979 B2 7/2003 Xue
6,631,722 B2 10/2003 Macadam et al.
6,647,870 B2 11/2003 Kohno
6,761,174 B2 7/2004 Jupe et al.
6,779,530 B2 8/2004 Kraker
6,848,449 B2 2/2005 Kitao et al.
6,904,917 B2 6/2005 Kitao et al.
7,074,170 B2 7/2006 Lanier, Jr. et al.
7,115,085 B2 10/2006 Deal
7,210,486 B2 5/2007 Hartmann
7,234,471 B2 6/2007 Fitzgerald et al.
7,237,559 B2 7/2007 Ashcraft et al.
7,275,548 B2 10/2007 Hancock et al.
7,281,540 B2 10/2007 Barnes et al.
7,296,578 B2 11/2007 Read, Jr.
7,434,585 B2 10/2008 Holmes
7,448,991 B2 * 11/2008 Lanier et al. ..... 493/40
7,479,098 B2 1/2009 Thomas et al.
7,972,254 B2 * 7/2011 Stokes et al. ..... 493/39
2003/0136419 A1 7/2003 Muller
2004/0261807 A1 12/2004 Dube et al.
2005/0066986 A1 3/2005 Nestor et al.
2006/0112964 A1 6/2006 Jupe et al.
2006/0130861 A1 6/2006 Luan et al.
2006/0144412 A1 7/2006 Mishra et al.
2006/0174901 A1 8/2006 Karles et al.
2006/0272655 A1 12/2006 Thomas et al.
2006/0272663 A1 12/2006 Dube et al.
2007/0012327 A1 1/2007 Karles et al.
2007/0068540 A1 * 3/2007 Thomas et al. ..... 131/88
2007/0095357 A1 5/2007 Besso et al.
2007/0246055 A1 10/2007 Oglesby
2008/0029118 A1 2/2008 Nelson et al.
2008/0142028 A1 6/2008 Fagg
2008/0302373 A1 12/2008 Stokes et al.

FOREIGN PATENT DOCUMENTS

WO WO 2004/047572 A1 6/2004
WO WO 2004/057986 A2 7/2004
WO WO 2006/136197 A1 12/2006
WO WO 2006/136199 A1 12/2006
WO WO 2007/010407 A3 1/2007
WO WO 2007/060543 A2 5/2007

OTHER PUBLICATIONS

Davis et al., *Tobacco Production, Chemistry and Technology*, 1999, pp. 440-460, Blackwell Science, Inc., Malden, MA.

* cited by examiner

FIG. 4
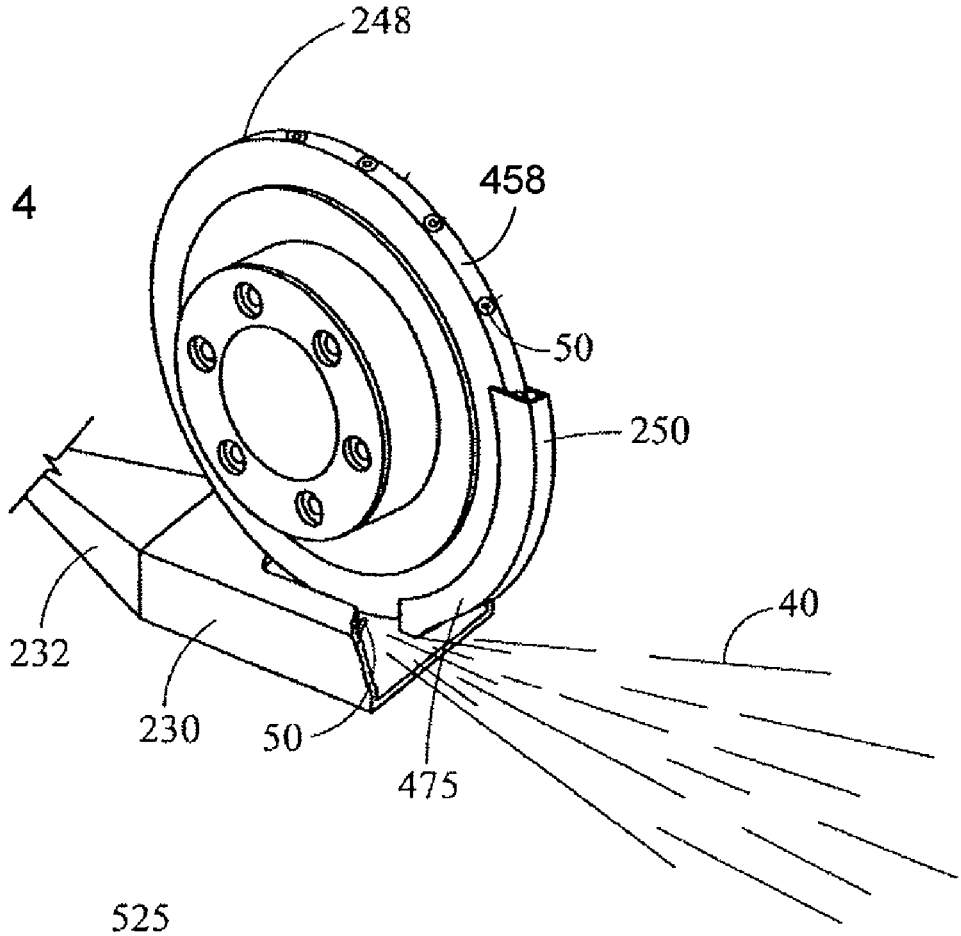
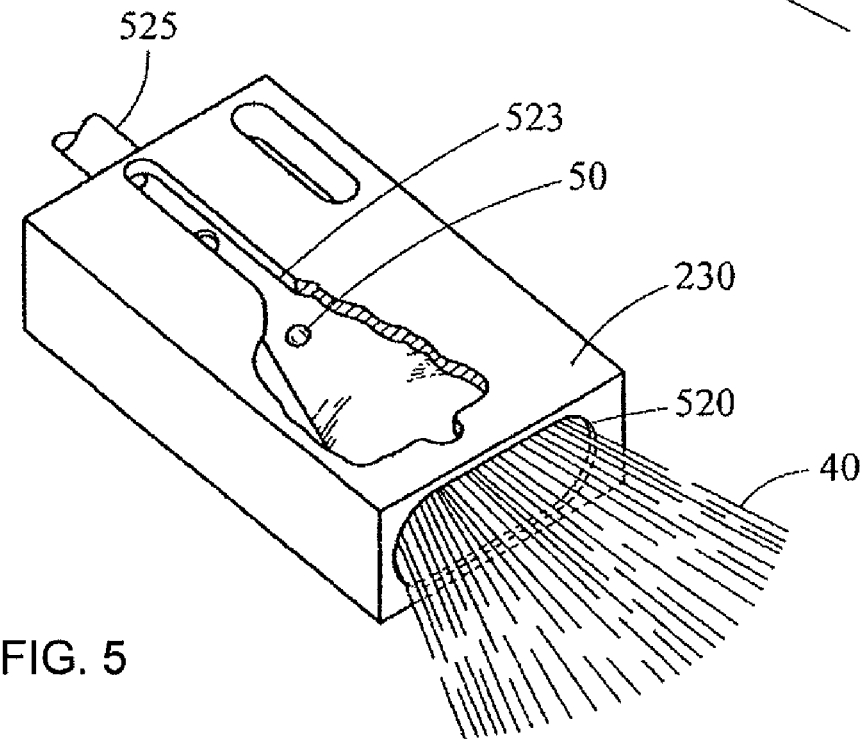
FIG. 5

APPARATUS FOR ENHANCING A FILTER COMPONENT OF A SMOKING ARTICLE, AND ASSOCIATED METHOD

BACKGROUND OF THE INVENTION

1. Field of the Invention

Embodiments of the present invention relate to apparatuses and methods for manufacturing filter rods and smoking articles incorporating such filter rods, and, more particularly, to apparatuses and methods for enhancing a characteristic of a filter rod for a smoking article, such as a cigarette.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R. J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. US Pat. Appl. Pub. No. 2002/0166563 to Jupe et al. proposes the placement of adsorbent and flavor-releasing materials in a cigarette filter. US Pat. Appl. Pub. No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al. U.S. Pat. No. 5,387,285 to Rivers proposes injecting a flavored fluid into the filter material and/or onto one or more strands inserted therein by use of a flavor (fluid) injection device operably engaged with a tongue or other components within a gathering region.

Cigarettes having adjustable filter elements that allow smokers to select the level of flavor that is available for transfer into mainstream smoke have been proposed. See, for example, U.S. Pat. No. 4,677,995 to Kallianos et al. and U.S. Pat. No. 4,848,375 to Patron et al. Some proposed cigarettes may be manipulated, reportedly for the purpose of providing components of their filter elements with the propensity to modify the nature or character of mainstream smoke. See, for example, U.S. Pat. No. 3,297,038 to Homburger; U.S. Pat. No. 3,339,557 to Karalus; U.S. Pat. No. 3,420,242 to Boukar; U.S. Pat. No. 3,508,558 to Seyburn; U.S. Pat. No. 3,513,859 to Carty; U.S. Pat. No. 3,596,665 to Kindgard; U.S. Pat. No. 3,669,128 to Cohen; and U.S. Pat. No. 4,126,141 to Grossman.

Some proposed cigarettes have a hollow object positioned in their filter element, and the contents of that object is reportedly released into the filter element upon rupture of the object in the attempt to alter the nature or character of the mainstream smoke passing through the filter element. See, for example, U.S. Pat. No. 3,339,558 to Waterbury; U.S. Pat. No. 3,366,121 to Carty; U.S. Pat. No. 3,390,686 to Irby, Jr. et al.; U.S. Pat. No. 3,428,049 to Leake; U.S. Pat. No. 3,547,130 to Harlow et al; U.S. Pat. No. 3,575,1809 to Carty; U.S. Pat. No. 3,602,231 to Dock; U.S. Pat. No. 3,625,228 to Dock; U.S. Pat. No. 3,635,226 to Horsewell et al.; U.S. Pat. No. 3,685,521 to Dock; U.S. Pat. No. 3,916,914 to Brooks et al.; U.S. Pat. No. 3,991,773 to Walker; U.S. Pat. No. 4,889,144 to Tateno et al.; and U.S. Pat. No. 7,115,085 to Deal; US Pat. Application Pub. Nos. 2004/0261807 to Dube et al; 2007/0095357 to Besso et al.; 2007/0012327 to Karles et al.; 2007/0068540 to Thomas et al.; 2006/0174901 to Karles et al.; 2006/0144412 to Mishra et al.; 2006/0112964 to Jupe et al.; and PCT WO 03/009711 to Kim and WO 2007/060543 to Besso et al.; and U.S. patent application Ser. No. 11/760,983 to Stokes et al. Some proposed cigarettes may also have a capsule positioned in the filter element, and the contents of that capsule reportedly released into the filter element upon rupture of the capsule in order to deodorize the filter element after the cigarette is extinguished. See, for example, US Pat. Appl. Pub. No. 2003/0098033 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. No. 4,865,056 to Tamaoki et al. and U.S. Pat. No. 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. No. 3,797,644 to Shaw; U.S. Pat. No. 4,003,387 to Goldstein; and U.S. Pat. No. 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. A flavor-containing capsule contained within the disposable filter reportedly may be squeezed in order to release the flavor within the capsule.

Some smokers might desire a cigarette that is capable of providing, in some instances, selectively, a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Accordingly, it would be desirable to provide a cigarette that is capable of providing distinctive, different pleasurable sensory experiences, for a smoker.

Some smokers might also desire a cigarette that is capable of releasing a deodorizing agent upon completion of a smoking experience. Such agents may be used to ensure that the remaining portion of a smoked cigarette yields a pleasant aroma after the smoker has finished smoking that cigarette. Accordingly, it is desirable to provide a cigarette that is capable of releasing a deodorizing agent, as desired by the smoker.

Some smokers might desire a cigarette that is capable of moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Accordingly, is desirable to provide a cigarette that is capable of moistening, smoothing or cooling the smoke delivered to a smoker, for that smoker.

It would be highly desirable to provide a smoker with the ability to enhance a sensory aspect of his/her smoking experience, and the extent or magnitude of that sensory experience, such as can be accomplished by allowing the smoker to purposefully select a cigarette having certain characteristics or behaviors and, in some instances, by allowing the smoker to determine the magnitude or extent of such characteristics or behaviors that the cigarette exhibits and/or the source thereof. That is, it would be desirable to provide a cigarette possessing components that can be employed so as to allow the smoker to select a cigarette based on an indicated character or nature and, in some instances, allow the smoker to control, whether selectively or not, the nature or character of the mainstream smoke produced by that cigarette, and the source from which it is obtained. In particular, it would be desirable to provide a cigarette that is capable of enhancing the sensory attributes, and the extent or magnitude of such attributes, of the mainstream smoke (e.g., by flavoring that smoke). More particularly, it would be desirable to provide the means to manufacture such cigarettes incorporating such flavor agents and sources, and the like, in a rapid, highly-automated fashion. It also would be desirable to provide improved means to incorporate liquid flavoring agents/substances in a manner substantially commensurately with the incorporation of smoke-altering solid objects such as flavor pellets, flavor capsules, flavored or non-flavored strands, exchange resin beads, adsorbent/absorbent particles, or possibly various combinations thereof, into cigarette filters, in a rapid, highly automated fashion.

BRIEF SUMMARY OF THE INVENTION

The present invention relates to an apparatus and process for providing filter rods for use in the manufacture of smoking articles, wherein each rod has one or more objects (e.g., rupturable capsules, pellets, strands, or combinations thereof) disposed along its length such that, when the rod is subdivided into rod portions, each rod portion includes at least one, and preferably a plurality, of such objects. Each rod further includes a liquid substance (e.g., flavoring agent) selectively applied along its length, wherein the liquid substance may be adapted to affect an attribute associated with the one or more objects. The apparatus incorporates equipment for supplying a continuous supply of filter material (e.g., a filter tow processing unit adapted to supply filter tow to a continuous rod forming unit), and an object insertion unit such as, for example, a hopper and rotating wheel arrangement as disclosed in U.S. Patent Application Publication No. US 2007/0068540 A1 to Thomas et al. (and incorporated herein by reference), for supplying the objects to the filter material. In a further example, the apparatus may include, for example, a tongue or tongue portion configured to gather the supply of filter material into a continuous rod. Such a tongue may also include, for instance, a tube extending into the filter material passing through the tongue, wherein the tube is configured to allow the objects (singularly or otherwise serially engaged) to pass therethrough into the filter material as the continuous rod is formed. In another example, the objects may be housed within a tubular member, and the apparatus may include, for instance, an object-insertion unit for inserting the tubular member having the objects therein into the filter material. In still another example, the objects may be serially attached or otherwise serially engaged with each other so as to form a continuous chain of objects, wherein the object-insertion unit would be configured to place the continuous chain of objects into the filter material. In any instance, the apparatus may also include a dispensing device operably engaged with the object insertion unit, wherein the dispensing device is configured to selectively dispense a liquid substance into the filter material, substantially commensurately with the introduction of the plurality of objects into engagement with the rod member, and wherein the liquid substance is configured to affect an attribute associated with the objects.

In still other instances, the objects may be attached or otherwise engaged with an elongate member, wherein the elongate member may comprise, for example, a strand. The objects are thus strung together by the strand. In such instances, the object-insertion unit is particularly configured to place or otherwise insert the strand and objects into the filter material. Further, the objects may be separate from the elongate member/strand, wherein the object-insertion unit is configured to place or otherwise insert the strand and objects, not engaged with each other, into the filter material. That is, multiple objects (i.e., capsules, pellets) and/or strands; or at least one of a capsule, pellet, or strand in combination with at least one other of the capsule, pellet, or strand; is inserted into the filter material by the object-insertion unit. One arrangement for inserting a strand into the filter material is disclosed, for example, in U.S. Patent Application Publication No. US 2008/0029118 to Nelson et al., which is incorporated herein by reference. In another example, the elongate member may also be configured to extend laterally (i.e., as a two dimensional sheet). In such an instance, the objects may be attached or otherwise engaged with the elongate member. In engaging the elongate member with the filter material, the apparatus may include, for example, a wrapping device configured to wrap the elongate member about the objects (i.e., so as to form a "tubular member"), wherein the object-insertion unit is configured to place the objects wrapped by the elongate member into the filter material. In yet another example, the apparatus may include a garniture device configured to wrap the elongate member having the objects attached thereto about the filter material such that the elongate member forms a wrap encompassing the filter material and the objects. Such examples of object insertion apparatuses are disclosed, for example, in U.S. patent application Ser. No. 11/760,983 to Stokes et al., which is incorporated herein by reference.

The apparatus further includes a dispensing device for selectively dispensing a liquid substance into the filter material, substantially commensurately with the introduction of the one or more objects into the filter material. The liquid substance is adapted to affect an attribute, such as, for example, enhancing a flavoring characteristic, associated with the one or more objects disposed in each filter rod. However, the liquid substance may, in other instances, interact with the object and/or any substances included therein to have a cooperative effect. For example, the object may include a substance that, when released therefrom, enhances the effect of the liquid substance, provides a combination effect with the liquid substance (i.e., a mix of flavors), or neutralizes or otherwise counteracts the effect of the liquid substance. In one example, the dispensing device may be operably engaged with an object-insertion unit. In another example, the dispensing device may be operably engaged with a rotating wheel arrangement such as that disclosed in U.S. Patent Application Publication No. US 2007/0068540 A1 to Thomas et al. (and incorporated herein by reference), for supplying the objects into the filter material.

As a result, the filter material is formed into a continuous rod having the one or more objects and a portion of the liquid substance positioned within that rod and along the longitudinal axis thereof. The continuous rod then is subdivided at predetermined intervals so as to form a plurality of filter rods or rod portions such that each rod portion includes at least one of the objects therein, as well as a portion of the liquid substance affecting an attribute of the at least one object. In instances of the objects comprising, for example, a capsule and/or a pellet, and also including a strand, the capsules and/or pellets may be disposed at predetermined positions within and along the filter rod or filter element, while the strand, if any, extends through the filter rod or filter element. Accordingly, embodiments of the present invention are particularly configured to provide the objects and place the same within the filter material, while substantially commensurately dispensing a liquid substance into the filter material, with the objects being sufficiently proximal to each other in a regularly spaced relationship such that a desired at least one object, and a portion of the liquid substance affecting an attribute thereof, per rod portion is obtained when the continuous rod is subdivided.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 4 is a perspective view of a portion of the object insertion unit showing the object insertion wheel;

FIG. 5 is a perspective view of a portion of the object insertion unit showing placement of individual objects within a continuous web of filter tow;

Figure 11:
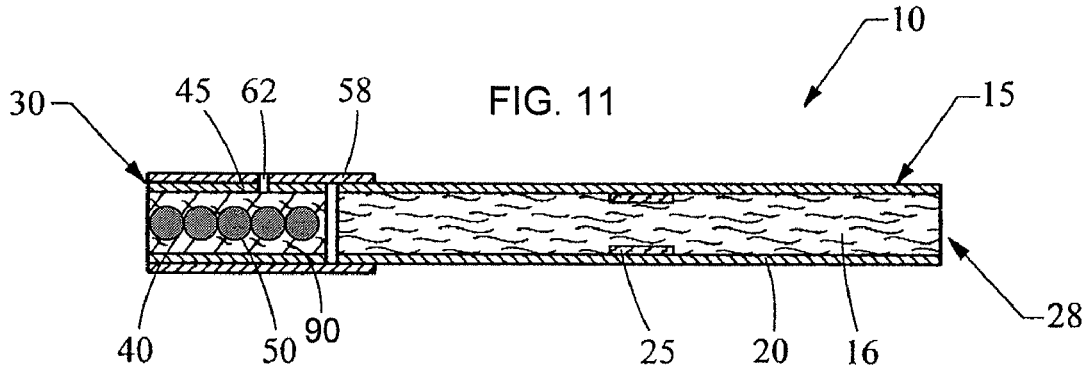
Figure 12:
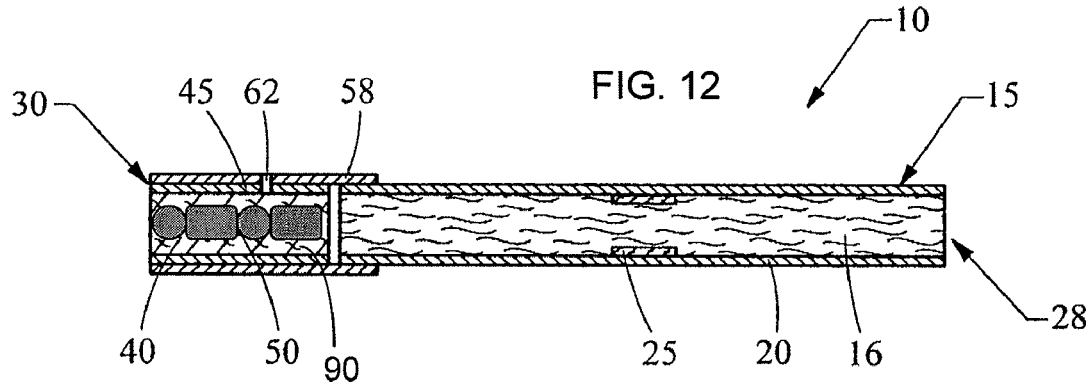

FIG. 11 is a cross-sectional view of a smoking article having the form of a cigarette, showing the smokable material, the wrapping material components, the interconnected objects-containing filter element of that cigarette, and a liquid substance dispensed within the filter element, according to one aspect of the present invention; and FIG. 12 is a cross-sectional view of a smoking article having the form of a cigarette, showing the smokable material, the wrapping material components, the non-interconnected objects-containing filter element of that cigarette, and a liquid substance dispensed within the filter element, according to one aspect of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Filtered cigarettes incorporating filter elements provided from filter rods that are produced in accordance with the present invention can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al.; and U.S. Patent Application Publication Nos. 2005/0103355 to Holmes and 2005/1094014 to Read, Jr.; each of which is incorporated herein by reference. The operation of those types of devices will be readily apparent to those skilled in the art of automated cigarette manufacture.

Cigarette filter rods that are produced in accordance with the present invention can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod produced in accordance with embodiments of the present invention. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, that are set forth in U.S. Pat. Nos. 5,220,930 to Gentry and U.S. Pat. No. 6,779,530 to Kraker; U.S. Patent Application Publication Nos. 2005/0016556 to Ashcraft et al. and 2005/0066986 to Nestor et al.; and U.S. Patent Application Publication Nos. US 2006/0272655 to Thomas et al. and US 2007/0246055 to Oglesby; each of which is incorporated herein by reference.

Filter rods can be manufactured pursuant to embodiments of the present invention using a rod-making apparatus, and an exemplary rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

Representative types of filter rods incorporating objects, and representative types of cigarettes possessing filter elements incorporating objects, such as flavor-containing capsules or pellets, can possess the types of components, format and configuration, and can be manufactured using the types of techniques and equipment set forth in U.S. Patent Application Publication Nos. 2005/0070409 A1 to Deal; 2007/0068540 A1 to Thomas et al.; U.S. Pat. No. 4,862,905 to Green, Jr. et al.; and U.S. Patent Application Publication No. 2008/0029118 to Nelson et al.; which are incorporated herein by reference in their entireties.

Figure 1:
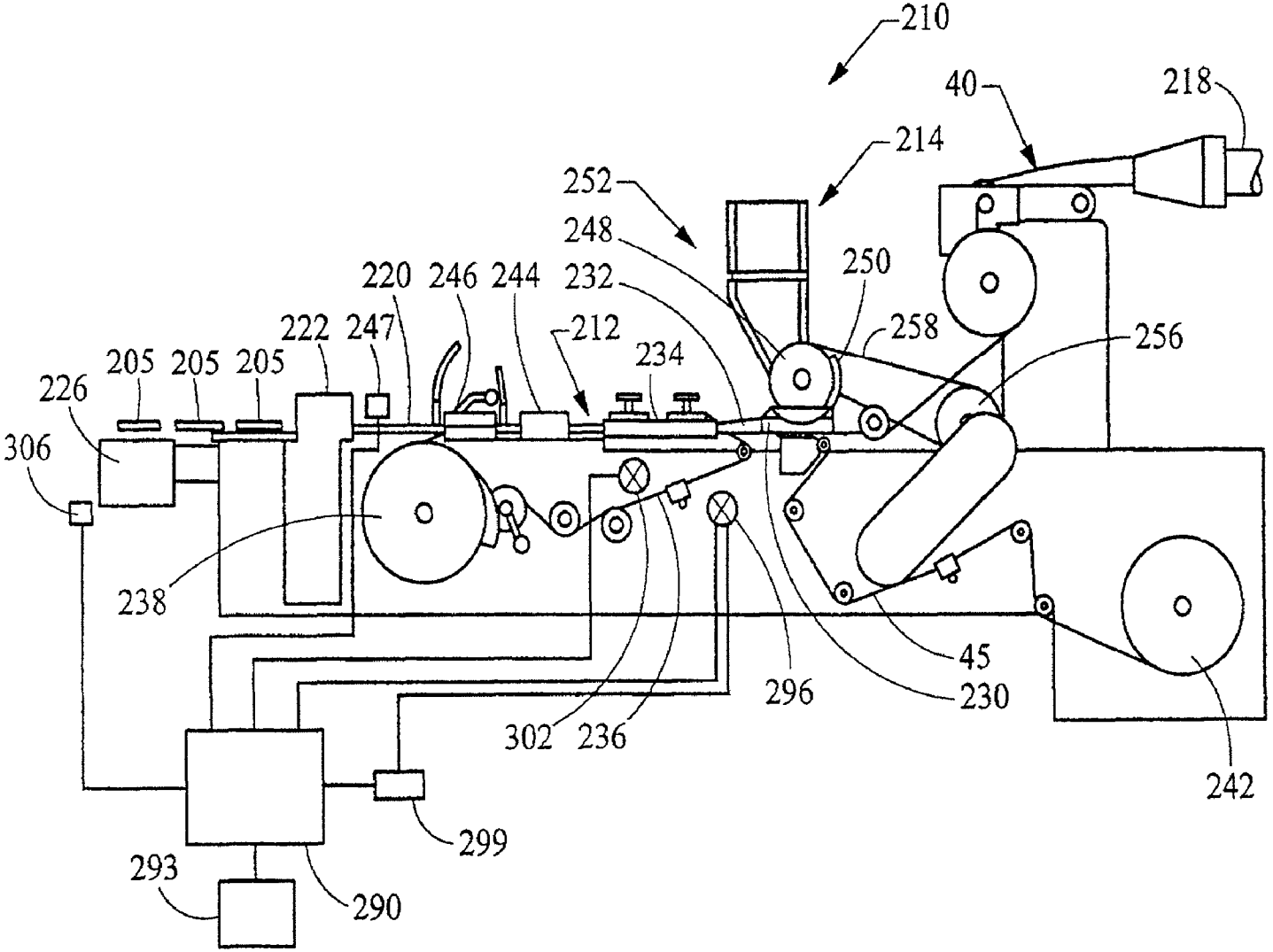
FIG. 1 is a diagrammatic illustration a rod-making apparatus including a portion of the filter tow processing unit, a source of objects, an object insertion unit, a dispensing device, and a filter rod-forming unit.

FIG. 1 illustrates that filter rods or rod portions 205, each incorporating at least one object, and preferably a plurality of objects (shown in FIG. 9), such as spherical, capsular, cylindrical (i.e., pellets), stranded, or other suitably shaped objects, and further incorporating a liquid substance, such as a flavoring agent, affecting an attribute of the object(s), may be manufactured using a rod-making apparatus 210. An exemplary rod-making apparatus 210 includes a rod-forming unit 212 (e.g., a KDF-2 unit available from Hauni-Werke Korber & Co. KG) and an object insertion unit 214 suitably adapted to provide for placement of the objects (not shown) within a continuous length of filter material 40, as well as a dispensing device 400 (FIGS. 6, 7A, 7B) suitably adapted to selectively dispense or otherwise inject the liquid substance into the continuous length of filter material, substantially commensurately with the placement of the objects therein. The continuous length of filter material is supplied from a source (not shown) such as a storage bale, bobbin, spool or the like. Generally, the filter material 40 is processed using a filter material processing unit 218. The continuous length of filter material having the objects and liquid substance received therein is passed through the rod-forming unit 212 such that a continuous rod 220 is formed. The continuous rod 220 can then be subdivided, using a rod cutting assembly 222, into a plurality of rod portions 205 each having at least one of the objects disposed therein, as well as a portion of the liquid substance. The succession or plurality of rod portions 205 are collected in a collection mechanism 226, such as a tray, a rotary collection drum, conveying system, or the like. If desired, the rod portions can be transported directly to a cigarette making machine. In such a manner, in excess of 500 rod portions, each of about 100 mm in length, can be manufactured per minute.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One highly preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

Filamentary tow, such as cellulose acetate, is processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin is applied to the filamentary tow in traditional amounts using known techniques. Other suitable materials for construction of the filter element will be readily apparent to those skilled in the art of cigarette filter design and manufacture.

The continuous length of filter material 40 is pulled through a block 230 by the action of the rod-forming unit 212 and the objects and liquid substance are introduced along the length of and into the filter material 40 as the filter material 40 is pulled therethrough. However, the objects and liquid substance may also be introduced into the filter material at other points in the process, as disclosed further herein, and this exemplary embodiment is not intended to be limiting in that regard. The filter material is further directed into a gathering region 232 of the rod-forming unit 212. The gathering region can have a tongue and horn configuration, a gathering funnel configuration, stuffer or transport jet configuration, or other suitable type of gathering mechanism. The tongue 232 provides for further gathering, compaction, conversion or formation of the cylindrical composite from block 230 into an essentially cylindrical (i.e., rod-like) shape whereby the continuously extending strands or filaments of the filter material extend essentially along the longitudinal axis of the cylinder so formed. In some instances, the objects and liquid substance may also be commensurately placed into the filter material in the gathering region 232, as appropriate, to minimize invasive operations with respect to that filter material.

The filter material 40, which has been compressed into a cylindrical composite, is received further into the rod-forming unit 212. The cylindrical composite is fed into wrapping mechanism 234, which includes endless garniture conveyer belt 236 or other garniture mechanism. The garniture conveyer belt 236 is continuously and longitudinally advanced using advancing mechanism 238 such as a ribbon wheel or cooperating drum so as to transport the cylindrical composite through wrapping mechanism 234. The wrapping mechanism provides a strip of wrapping material 45 (e.g., non-porous paper plug wrap) to the outer surface of the cylindrical composite in order to produce continuous wrapped rod 220. In some instances, the objects may also be engaged with the filter material in the wrapping or garniture region 232, as appropriate. For example, the elongate member, as otherwise disclosed herein, may be in the form of a wrapping material 45 having the objects attached thereto or otherwise engaged therewith. In some instances, the elongate member may also include, for example, microcapsules (see, e.g., U.S. Patent Application Publication No. 2008/0142028 to Fagg, incorporated herein by reference) instead of or in addition to the objects, wherein the elongate member/wrapping material is wrapped about the filter material such that the objects/microcapsules are applied thereto.

Generally, the strip or web of wrapping material 45 is provided from rotatable bobbin 242. The wrapping material is drawn from the bobbin, is trained over a series of guide rollers, passes under block 230, and enters the wrapping mechanism 234 of the rod-forming unit. The endless garniture conveyer belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing mechanisms and other types of adhesives can be employed in providing the continuous wrapped rod.

The continuous wrapped rod 220 passes from the sealing mechanism and is subdivided (e.g., severed) at regular intervals at the desired, predetermined length using cutting assembly 222 which includes as a rotary cutter, a highly sharpened knife, or other suitable rod cutting or subdividing mechanism. It is particularly desirable that the cutting assembly does not flatten or otherwise adversely affect the shape of the rod. The rate at which the cutting assembly severs the continuous rod at the desired points is controlled via an adjustable mechanical gear train (not shown), or other suitable mechanism. The rate at which the objects and liquid substance are introduced into the continuous web of filter material is in a direct relationship to the speed of operation of the rod-making machine. The object insertion unit can be geared in a direct drive relationship to the drive assembly of the rod-making apparatus. Alternatively, the object insertion unit can have a direct drive motor synchronized with the drive assembly of the rod-forming unit and feedback controlled by coupling with the object inspection mechanism 247 to adjust the insertion unit drive assembly should the object insertion location shift out of the desired position. In any instance, the dispensing device 400 can be synchronized with the object insertion unit such that the liquid substance is dispersed proximate to the object(s). In light of the relationship of the rate of object insertion/dispensing of the liquid substance and the rod-making machine, embodiments of the present invention are also directed to increasing the production rate of the rod-making machine without adversely affecting the object/liquid substance insertion into the filter material.

In one embodiment, the object insertion unit 214 may include a rotatable insertion member 248 having the shape of a wheel, which may be positioned so as to rotate in a vertical plane. The object insertion unit 214 may also include a hopper assembly 252 and/or other transfer mechanism for feeding or otherwise providing transfer of objects (such as, for example, capsules and/or pellets) to insertion wheel 248. As the insertion wheel rotates in a clock-wise fashion, individual objects (not shown) held within pocket (not shown) on the peripheral face of the wheel are brought into contact with the filter material 40 within the block 230, where the objects are ejected/released from the pockets into the gathered filter material 40. Details of such an object-insertion arrangement are further detailed, for example, in U.S. Patent Application Publication No. US 2007/0068540 A1 to Thomas et al., though embodiments of the present invention as disclosed herein implement a relatively closer spacing of the objects along the length of the filter rod or rod portion 205. That is, the insertion wheel 248 may be configured so as to place the objects in closer proximity to each other or immediately adjacent to each other. For example, the pockets may be more closely spaced or the insertion wheel 248 configured in a different manner so as to, for instance, receive and deliver the objects in a substantially consistent and continuous feed.

Figure 2A:
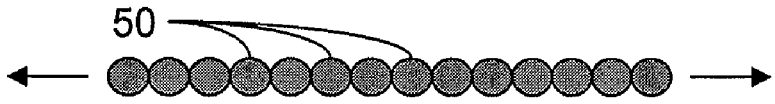
FIGS. 2A-2E are schematic views of various embodiments of interconnected objects, according to aspects of the invention.

In still another example, the objects 50 may be serially attached or otherwise engaged so as to be placed in the filter material as a continuous chain (see, e.g., FIG. 2A). That is, the objects 50 may be directly joined to each other using, for example, an adhesive or by binding to each other in the presence of heat. The hopper assembly 252 would thus be replaced by other transfer mechanisms for feeding or otherwise providing the continuous chain of objects 50 to insertion wheel 248. The continuous chain of objects 50 would be placed within the filter material using an appropriately modified insertion wheel 248 or other suitable insertion device. For instance, the continuous chain of objects 50 could be stored on a bobbin, spool, or other appropriate storage and dispensing device in proximity to the insertion wheel 248 or other suitable insertion device for inserting the continuous chain into the filter material. Having incorporated U.S. Patent Application Publication No. US 2007/0068540 A1 to Thomas et al. by reference, the details and operation of the hopper assembly 252/insertion wheel 248 are not otherwise described in detail herein, but instead are referenced to that publication.

In controlling this process, a typical control system includes control hardware and software. An exemplary control system 290 can incorporate a Siemens 315-2DP Processor, a Siemens FM352-5 (Booleen Processor) and a 16 input bit/16 output bit module. Such a system can utilize a system display 293, such as a Siemens MP370. A typical rod-making unit possesses internal controls whereby, for a rod of desired length, the speed of the knife of the severing unit is timed relative to the speed of continuous rod formation. A first encoder 296, by way of connection with the drive belt of the rod-making unit, and with the control unit 299 of the object insertion unit 214, provides reference of the knife position of the cutting assembly relative to the wheel position of the insertion unit. Thus, the first encoder 296 provides a mechanism for allowing control of the speed of rotation of the insertion wheel 248 of the object insertion unit 214 relative to the speed at which continuous web of filter tow passes through the rod-making unit. An exemplary first encoder is available as Heidenhain Absolute 2048.

Figure 2B:
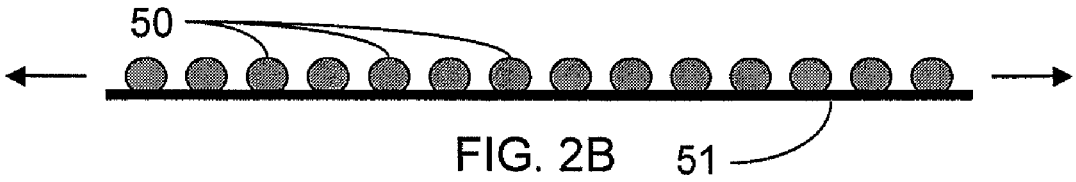
Figure 2C:
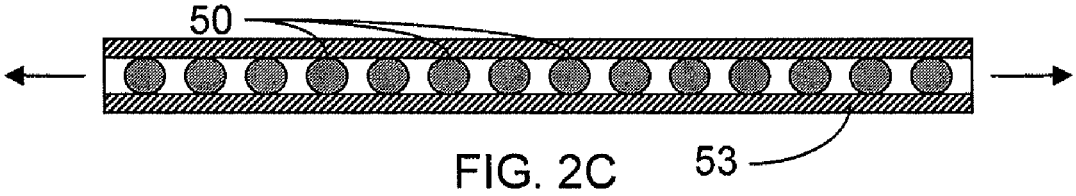
Figure 2D:
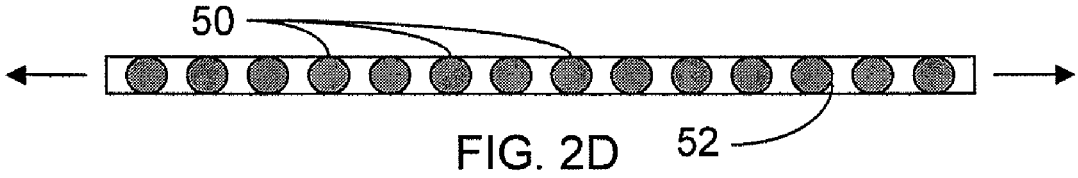
Figure 2E:
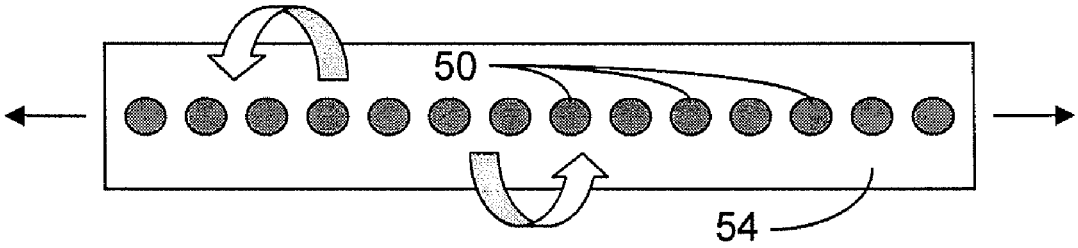

In some instances, the objects 50 may be attached to or otherwise engaged with the strand 51 (FIG. 2B), or other elongate member, wherein such an elongate member may comprise, for instance, a strip of material 52 (FIG. 2D) having a laterally-extending dimension. In other instances, the objects 50 may be housed, for example, within an elongate member comprising a tube 53 (FIG. 2C). In still other instances, the elongate member may comprise, for instance, a strip of material 54 (FIG. 2E) having a larger laterally-extending dimension, with the objects 50 attached to or otherwise engaged therewith, wherein the strip of material 54 is laterally-wrapped about the objects 50, using a wrapping device (not shown), prior to insertion of the wrapped objects into the filter material. In any such instances, the objects 50 may be attached to or otherwise engaged with the elongate member using an adhesive or other suitable material. The elongate member having the objects attached to or otherwise engaged therewith may be formed and stored on (e.g., wrapped about) a bobbin or other suitable spool member, and provided for placement within the filter material, as appropriate.

An inspection/detection system 247 may be located near the cutting assembly. The detection system, such as an infrared detection system, relays information regarding the detection of an object within the filter rod to the control system 290. Typically, the objects within the filter rod are of a contrasting shade or color to be detected by visual detection sensors in the detection system 247. In other instances, the inspection/detection system 247 may be appropriately modified so as to be capable of detecting/inspecting various objects. For example, the inspection/detection system 247 may be configured to detect/inspect a capsule, a pellet, and strand, or any multiples or combinations thereof. Such an inspection/detection system 247 is disclosed, for example, in U.S. Patent Application Publication No. US 2007/0068540 A1 to Thomas et al. previously incorporated by reference.

The rod-making apparatus optionally can be equipped with a system adapted to provide information associated with rod production and operation event analysis. For example, a rod-making apparatus, such as a commercially available KDF-2 type of unit, can be adapted so as to be equipped with a central processing unit. A representative central processing unit is available as a Siemens 314-C processor. The central processing unit is equipped with input and output modules. As such, the operation of the rod-making unit can be monitored, and data so generated can be transferred to the central processing unit. In addition, data received by the central processing unit can be presented on a video touch screen or retrieved by a high level operating system (e.g., via an Ethernet). Remote unit such as Siemens IM-153 equipped with inputs, outputs and a counter module available as Siemens FM350-2 installed in sending unit collects data provided to the central processing unit using a bus system (e.g., Profibus). Depending upon information gathered, data that can be generated may relate to number of rods manufactured during a particular time frame, machine operating speed, manufacturing efficiency, number of stops, filters sent to a cigarette-making machine and stoppage reasons.

Referring to FIG. 4, the continuous web of filter material 40 is fed into guide or block 230 (shown as partially cut away). The block 230 receives the wide band of filter material 40, and gradually forms the web into a composite, which generally resembles a cylindrical composite. The plow region 475 of the ledger housing 250 separates or spreads the filter material 40 such that the objects 50 are positioned or placed from the peripheral face 458 of the wheel 248 into the desired locations within the web of filter material and along the longitudinal axis thereof. When the tow reaches the endmost portion of the plow, the motion of the tow acts to close itself into a cylindrical composite, which encloses, surrounds or contains the objects along the length of and within the continuous web. A suitable plow preferably extends to a maximum depth of about 6 mm to about 6.5 mm into the web of filter material. The insertion unit can be raised or lowered in order that the objects be inserted at the desired depth within the filter material. In such a manner, a series of objects 50 is positioned in the web of filter material along the length of and within the cylindrical composite that exits the block 230 and enters the tongue 232 or other suitable gathering means.

Referring to FIG. 5, the guide or block 230 (the top portion of which is shown as partially cut away) has a relatively wide opening 520 at one end in order that the filter material 40 can be fed therein. The shape of the hollow inner portion of the block is such that the filter material is formed into a composite, which more generally resembles a cylinder. In particular, the inner portion of the block 230 is a hollow region or cavity in order that the filter material can be passed therethrough. The block has a longitudinally extending slot 523 along the top portion thereof in order to allow the rotating wheel and ledger housing (not shown) to extend into the web of filter material and to insert the objects 50 therein. In a suitable situation, the plow (not shown) extends into the slot 523 so as to extend about 0.3 mm to about 0.4 mm from the extreme bottom portion of the hollow inner portion of the block. The resulting cylindrical composite 525 is received to further downstream processing regions of the rod-forming unit. Similar types of blocks are set forth in U.S. Pat. No. 4,862,905 to Green, Jr. et al.

Figure 3A:
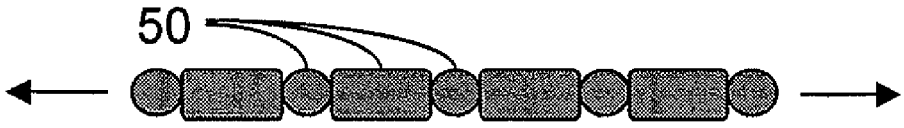
FIGS. 3A-3D are schematic views of various embodiments of combinations of non-interconnected multiple objects, according to aspects of the invention.
Figure 3B:
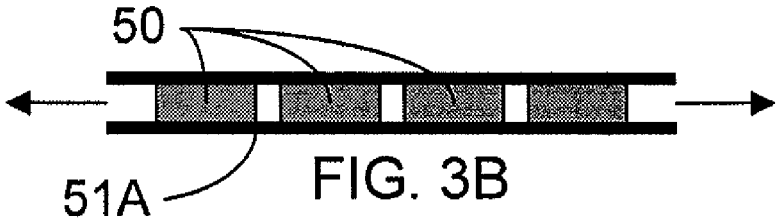
Figure 3C:
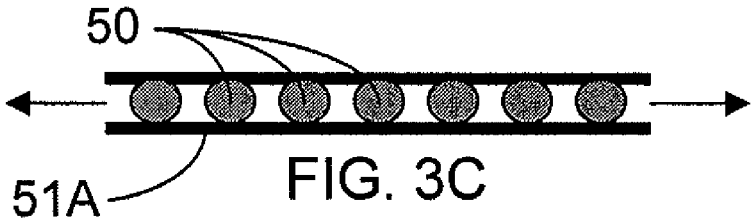
Figure 3D:
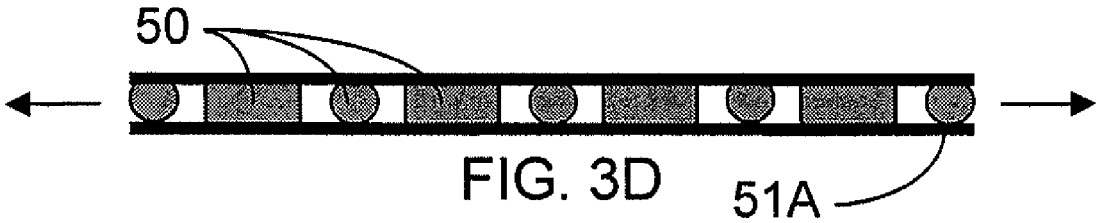

One skilled in the art will also appreciate that the rod-making apparatus 210 may optionally include more than one such block 230 and insertion wheel 248 assembly, where such a plurality of assemblies may be, for example, disposed in series. In other instances, a single block 230 may be configured with more than one such insertion wheel 248. For example, where each insertion wheel 248 has a diameter of between about 135 mm and about 140 mm, a pair of insertion wheels 248 may be mounted with respect to a single block 230 with about 150 mm center-to-center spacing. In instances of more than one object-insertion device (i.e., more than one block/insertion wheel assembly or more than one insertion wheel per single block), the rod-making apparatus 210 may be configured to place a mixed plurality of objects 50 (i.e., various combinations of objects such as, for example, capsules, pellets, or strands) into the filter material, with each of the object-insertion devices handling a different type of object. In continuation of the example, the plurality of object-insertion devices may be configured to deposit into the filter material, for instance, a combination of various objects 50 such as a capsule and a pellet (see, e.g., FIG. 3A), a combination of a capsule and a strand 51A (see, e.g., FIG. 3C), a combination of a pellet and a strand 51A (see, e.g., FIG. 3B), or a combination of all three objects 50 such as a capsule, pellet, and strand 51A (see, e.g., FIG. 3D). In some instances, the block/insertion wheel assemblies (multiple assemblies) or the insertion wheels (single block/multiple insertion wheels) may also be modularly configured or otherwise optional such that the number of object-insertion devices may be varied as necessary or desirable. In order to accomplish the desired configuration of object insertion, the plurality of object-insertion devices may be coordinated and/or synchronized in various manners, such as by timing, sensing, or any other suitable scheme.

Figure 6:
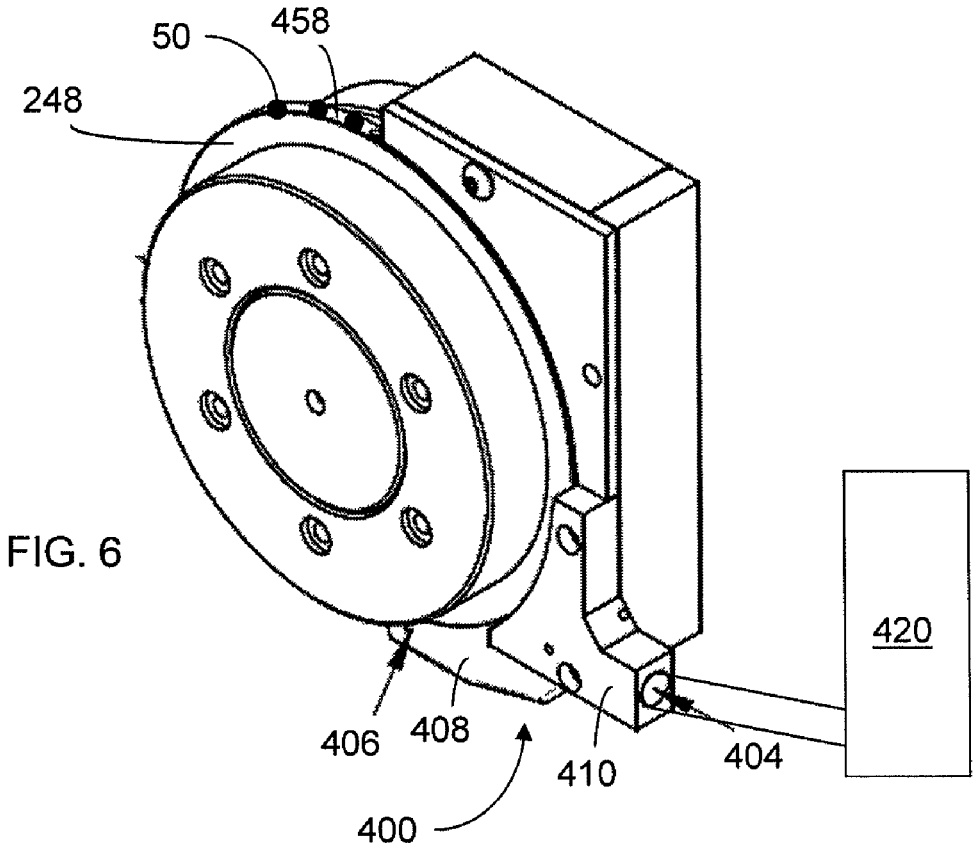
FIG. 6 is a perspective view of an object insertion unit coupled with a dispensing device configured to selectively dispense a liquid substance into a filter material, according to one embodiment of the present invention.
Figure 7A:
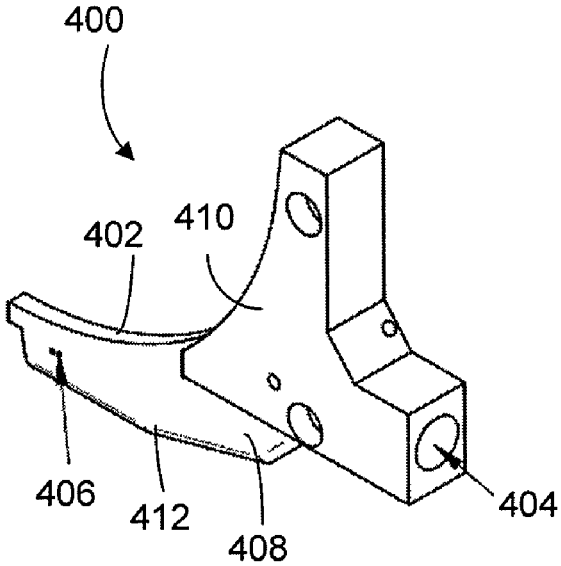
FIGS. 7A and 7B are perspective views of a dispensing device configured to selectively dispense a liquid substance into a filter material, according to one embodiment of the present invention.
Figure 7B:
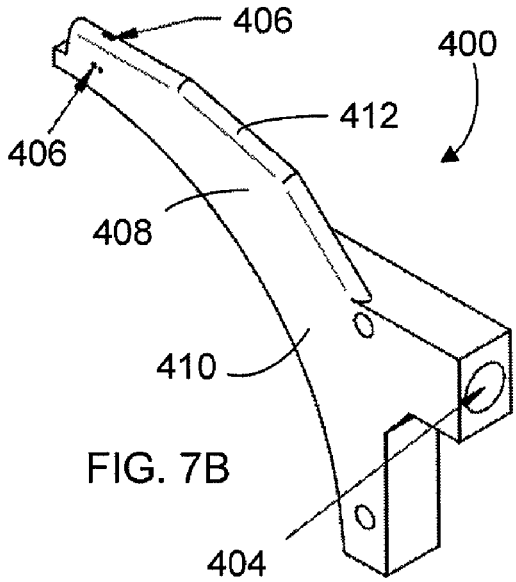

With reference to FIGS. 6, 7A, and 7B, a dispensing device 400 may also be provided to selectively dispense or otherwise inject a liquid substance 90 (FIGS. 8-12) into the filter material, substantially commensurately with the introduction of the objects 50 into the filter material. In this manner, some embodiments of the present invention are directed to increasing the production rate of the rod-making machine. The liquid substance 90 may include, for example, a flavoring agent (e.g. menthol) or other substance capable of affecting an attribute of the objects 50. More particularly, for instance, a liquid substance comprising a flavoring agent may be introduced into the filter material for enhancing a flavoring characteristic associated with the one or more objects disposed in each filter rod. However, the liquid substance may, in other instances, interact with the object and/or any substances included therein to have a cooperative effect. For example, the object may include a substance that, when released therefrom, enhances the effect of the liquid substance, provides a combination effect with the liquid substance (i.e., a mix of flavors), or neutralizes or otherwise counteracts the effect of the liquid substance. In one instance, the liquid substance 90 may interact with the objects 50 to affect the characteristics of the smoke drawn through the filter material.

The addition of one or more additives to the filter of the smoking article, such as flavorants (flavoring agents) and the like, enhances the flavor or other characteristics of the smoke as it is drawn therethrough by the user. In this regard, such enhancement may be maximized by selectively distributing the liquid additive substance (otherwise referred to herein as "liquid substance 90") through the filter tow material such that the liquid additive substance is distributed at a predetermined location relative to the longitudinal axis of the tow. In general, it is desirable to uniformly distribute the liquid additive substance along the central or longitudinal axis of the filter tow material. Uneven or eccentric distribution of a liquid flavorant substance may result in an inconsistent and undesirable tobacco smoke taste, or flavorant may not necessarily have the desired effect. In other embodiments, the dispensing device 400 may be configured to insert other substances/materials, such as, for example, a carbonaceous material, commensurately with the objects 50 being introduced into the filter material, wherein the substances/materials may be in a powder or non-liquid form.

The dispensing device 400 may be controlled by the control system controlling the object insertion unit 214 or, in other instances, a discrete control system remote from the system controlling the object insertion unit 214. In any instance, the control system may be configured to direct that the liquid substance and objects 50 be commensurately placed into the filter material.

In some embodiments, the object insertion unit 214 may define the dispensing device 400 in an integrally-formed manner. In other instances, the dispensing device 400 may be operably engaged with or otherwise coupled to (i.e., mounted to) the object insertion unit 214 (e.g., insertion wheel 248) so as to be proximally arranged in the rod-making process to promote or facilitate the commensurate insertion thereof into the filter material. The dispensing device 400 may define at least one supply channel 412 for dispensing the liquid substance therethrough into the filter material. The dispensing device may further define an inlet 404 in fluid communication with the supply channel 412. The inlet may be configured to receive the liquid substance from, for example, the reservoir 420.

In one particular embodiment, the dispensing device may be coupled with the objection insertion unit 214 such as, for example, the insertion wheel 248. In such embodiments, the dispensing device 400 may include a body portion 410, which defines the supply channel 412 such that the liquid substance may flow therethrough. The body portion 410 may include an arcuate portion 402 configured to correspondingly mate with the insertion wheel 248 to facilitate engagement therewith. Further, the body portion 410 may define the inlet 404 for receiving the liquid substance from the reservoir 420. The body portion 410 may further define one or more outlets 406 for dispensing the liquid substance into the filter material.

In some instances, the liquid substance is delivered to the inlet 404 under pressure such that the liquid substance is forced out of the outlets 406 and into the filter material (i.e., an injection process). A regulator and/or purge mechanism may be provided such that the liquid substance can be selectively delivered to the filter material in a metered manner commensurately with the objects 50 being positioned into the filter material. In this respect, the liquid substance can be metered to dispense a predetermined amount of the liquid substance into the filter material. According to some embodiments, during operation of the rod-making apparatus 210, the liquid additive substance, such as a flavorant, from the reservoir 420 is fed into the inlet 404 of the dispensing device 400. In some instances, the injection/delivery of the liquid additive substance may be accompanied by the injection of a gaseous fluid, such as pressurized air, for atomizing the liquid additive for injection into the filter material. In such instances, if a gaseous fluid is used to atomize the liquid additive substance, a pressurized gas supply, e.g., air, is fed via a throttle valve and shut-off valve through a conduit into a second inlet of the dispensing device 400.

A separating device 408 may be provided to separate the filter material to facilitate the introduction of the objects 50 and liquid substance therein so as to promote incorporation of the objects 50 and liquid substance into the central portion of the filter material (i.e., with respect to the cross-section thereof). That is, a leading edge of the separating device 408 (with respect to the directional path of the filter material) interacts with the filter material to provide at least some separation thereof in the longitudinal direction and to a depth approaching the centroid of the cross-section of the filter material. In some instances, the separating device may be separately provided from the dispensing device 400 and/or the objection insertion unit 214. In other instances, the separating device may be integrally-formed with one of the dispensing device 400 and the object insertion unit 214. For example, the dispensing device 400 may include the separating device 408 operably engaged with or otherwise integrally formed with the body 410. In this manner, the separating device 408 may be substituted for the plow region 475 of the ledger housing 250 (FIG. 4). The separating device 408 of the dispensing device 400 acts to separate or spread the filter material 40 (i.e., separate the filter material in the longitudinal direction), as the filter material is directed therepast such that the objects 50 are dispensed from the peripheral face 458 of the wheel 248 into the desired locations within the filter material and along the longitudinal axis thereof. Further, the separating device 408 of the dispensing device 400 is also configured to separate or spread the filter material 40 as the filter material is moved therepast such that the liquid substance is dispensed from the dispensing device 400 into the desired locations within the web of filter material and along the longitudinal axis thereof in a desired proximity to the objects 50.

When the tow reaches the endmost portion of the separating device 408, the motion of the tow acts to close itself into a cylindrical composite, which encloses, surrounds or contains the objects 50 and liquid substance along the length of and within the continuous web. A suitable separating device 408 preferably extends to a maximum depth of about 6 mm to about 6.5 mm into the web of filter material. The object insertion unit 214/dispensing device 400 may also be raised or lowered in order that the objects 50 and liquid substance be inserted at the desired depth within the filter material. In such a manner, a series of objects 50 and liquid substance segments are positioned in the web of filter material along the length of and within the cylindrical composite that exits the block 230. One skilled in the art will also appreciate that the rod-making apparatus 210 may optionally include more than one insertion wheel 248 and dispensing device 400 assembly, where such a plurality of assemblies may be, for example, disposed in series.

Various types of objects and the dimensions thereof are set forth below. The objects can vary. Each object may possess a generally spherical shape and, most preferably, is highly spherical in nature. Some objects can be generally solid in nature. Some objects can be composed of a plastic material; and each can be, for example, a solid spherical bead composed of a mixture of polyethylene and flavor, or a spherical bead having the form of exchange resin or gel. Some objects can be composed of an inorganic material; and can be for example, a spherical alumina bead. The objects also can each have the form of a spherical bead composed of a carbonaceous material. The objects also can each have the form of a hollow sphere. Typical hollow objects are liquid-containing objects, such as breakable capsules, which are highly spherical, are uniform in size and weight, have surface properties that allow such objects to be processed efficiently and effectively using automated filter making equipment, and are highly uniform in composition. Some objects have diameters of about 3 mm to about 4 mm, preferably about 3.5 mm, and the components of the preferred filter rod-making equipment of the present invention are suitably adapted or designed to efficiently and effectively produce filter rods incorporating those types of objects. Preferred hollow objects have sufficient physical integrity to not rupture during handling and insertion thereof into the filter material.

Other types of objects, beads, capsules and capsule components that can be employed for the production of filter rods using the foregoing filter rod manufacturing techniques and equipment are of the type set forth in U.S. Pat. No. 3,685,521 to Dock; U.S. Pat. No. 3,916,914 to Brooks et al.; and U.S. Pat. No. 4,889,144 to Tateno et al.; US Pat. Appl. Pub. No. 2003/0098033 to MacAdam et al. and 2004/0261807 to Dube et al.; and PCT Application Pub. No. WO 03/009711 to Kim; which are incorporated herein by reference. Tobacco products can incorporate those types of components set forth in US Patent Publication Nos. 2006/0272663 to Dube et al., 2006/01330961 to Luan et al., 2006/0144412 to Mishra et al.; 2007/0012327 to Karles et al.; and 2007/0068540 to Thomas et al.; PCT WO 2006/136197; PCT WO 2006/136199; PCT WO 2007/010407 PCT WO 2007/060543 and U.S. Pat. No. 7,115,085 to Deal; and U.S. patent application Ser. No. 11/760,983 to Stokes et al., as well as within filtered cigarettes that have been marketed under the tradenames "Camel Lights with Menthol Boost" and "Camel Crush" by R. J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R. J. Reynolds Tobacco Company.

Figure 8:
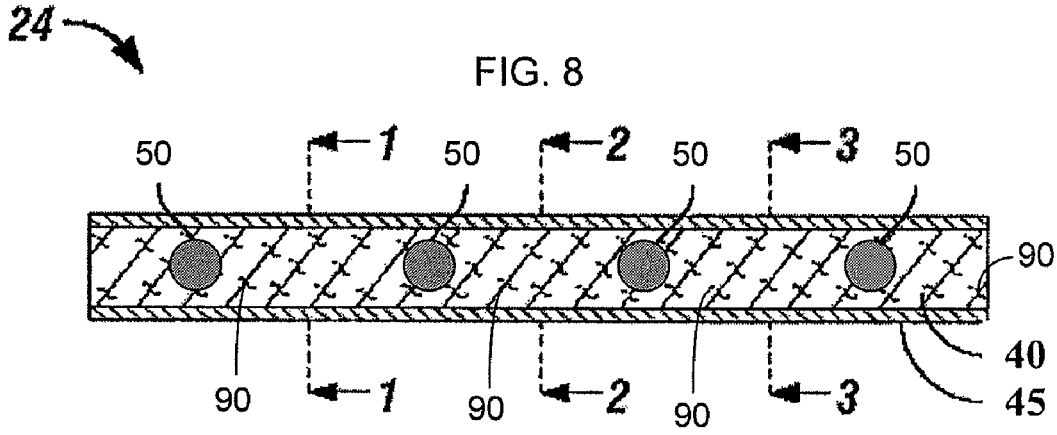
FIG. 8 is a cross-sectional view of a representative filter rod including filter material having an object and a liquid substance disposed therein, according to one aspect of the present invention.
Figure 9:
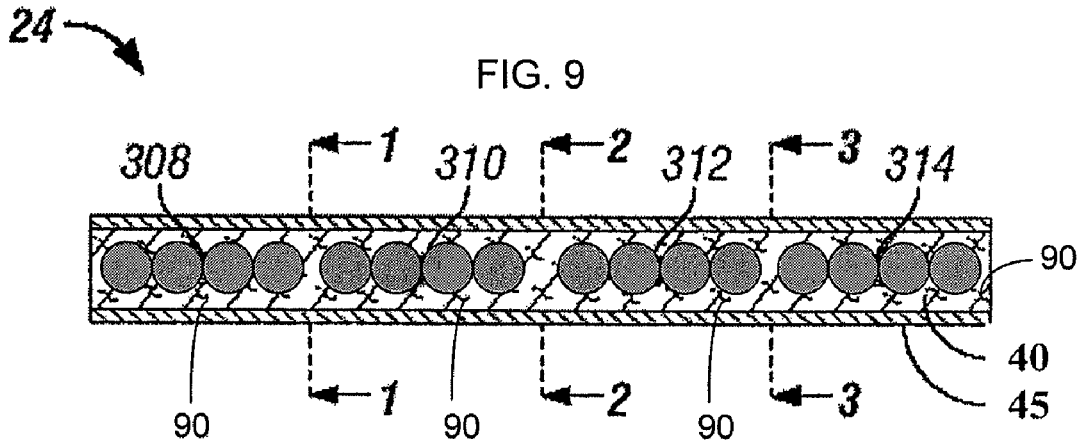
FIG. 9 is a cross-sectional view of a representative filter rod including filter material having interconnected objects and a liquid substance positioned therein, according to one aspect of the present invention.

Referring to FIGS. 8 and 9, filter rod 24 generally can be further subdivided into cylindrical shaped filter elements or rod portions using techniques as are known by the skilled artisan familiar with conventional cigarette manufacturing, and as described above. The filter rod 24 includes filter material 40 encased in circumscribing wrapping material 45 such as conventional air permeable or air impermeable paper plug wrap, or other suitable wrapping material. As an example, at least one object 50 (FIG. 8), and in some instances a plurality of objects 308, 310, 312 and 314 (FIG. 9; shown spaced apart groups for clarity, but essentially adjacent to each other) may be disposed along the longitudinal axis of and within the rod 24, and may be disposed in a spaced apart relationship from one another, or immediately adjacent to each other so as to be, in some instances, serially engaged. In other instances (not shown), the objects may be disposed so as to have a repeating pattern of groups of objects (each group comprising one or more objects) separated by a space, wherein the space would correspond to a division between filter rod portions. One skilled in the art will note that the entire filter rod may include sufficient one or more objects therein such that each filter rod portion includes the same number of one or more objects when the filter rod is subdivided. For example, a four-up filter rod may include objects in multiples of four such that, upon subdivision, each filter rod portion may include 1, 2, 3, or 4 objects. Further, a liquid substance 90 may be dispensed into the rod 24 and proximate to the at least one object 50 such that the liquid substance 90 can affect an attribute of the at least one object 50.

Figure 10:
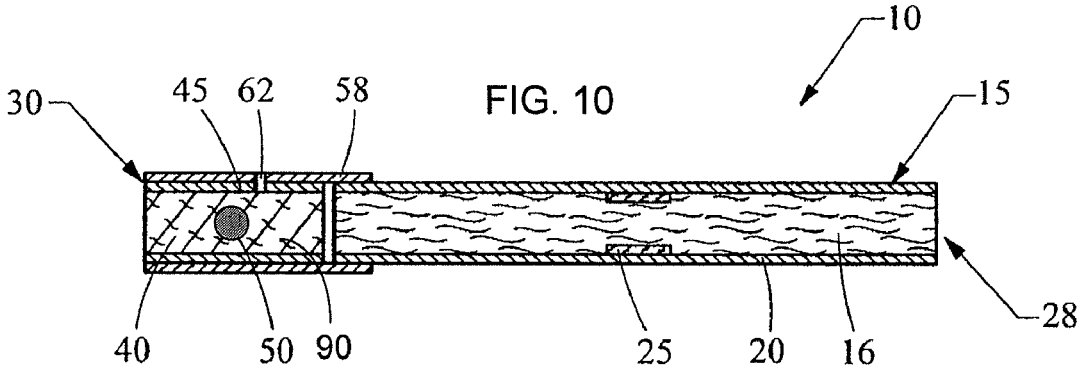
FIG. 10 is a is a cross-sectional view of a smoking article having the form of a cigarette, showing the smokable material, the wrapping material components, an object-containing filter element of that cigarette, and a liquid substance dispensed within the filter element, according to one aspect of the present invention.

Referring to FIGS. 10 and 11, there is shown a smoking article 10, such as a cigarette, possessing certain representative components of a smoking article. The cigarette 10 includes a generally cylindrical rod 15 of a charge or roll of smokable filler material 16 contained in a circumscribing wrapping material 20. The rod 15 is conventionally referred to as a "tobacco rod." The ends of the tobacco rod are open to expose the smokable filler material. The cigarette 10 is shown as having one optional band 25 (e.g., a printed coating including a film-forming agent, such as starch, ethylcellulose, or sodium alginate) applied to the wrapping material 20, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) as shown, or less preferably, on the outer surface of the wrapping material. Although the cigarette can possess a wrapping material having one optional band, the cigarette also can possess wrapping material having further optional spaced bands numbering two, three, or more.

The wrapping material 20 of the tobacco rod 15 can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; and U.S. Pat. Application Pub. Nos. 2004/0129281 to Hancock et al.; and 2005/0039764 to Barnes et al.; and PCT Application Pub. No. WO 2004/057986 to Hancock et al.; and PCT Application Pub. No. WO 2004/047572 to Ashcraft et al.; which are incorporated herein by reference in their entireties.

At one end of the tobacco rod 15 is the lighting end 28, and at the other end is positioned a filter element 30. The filter element 30 positioned adjacent one end of the tobacco rod 15 such that the filter element and tobacco rod are axially aligned in an end-to-end relationship, preferably abutting one another. Filter element 30 may have a generally cylindrical shape, and the diameter thereof may be essentially equal to the diameter of the tobacco rod. The ends of the filter element permit the passage of air and smoke therethrough. The filter element 30 includes filter material 40 (e.g., cellulose acetate tow impregnated with triacetin plasticizer) that is overwrapped along the longitudinally extending surface thereof with circumscribing plug wrap material 45. That is, the filter element 30 is circumscribed along its outer circumference or longitudinal periphery by a layer of plug wrap 45, and each end is open to expose the filter material 40.

Within the filter element 30 is positioned at least one object 50, and in other instances a plurality of objects 50 (including, for example, capsules, pellets, strands), including various combinations of different objects 50 (see, e.g., FIG. 12). The number of objects within each filter element, most preferably is a pre-determined number, and that number can be 1, 2, 3, or more (i.e., at least one). In some embodiments, each filter element contains a plurality of objects disposed within the filter material 40 of the filter element, in some instances, particularly towards the central region of the filter element. The nature of the filter material 40 may be such that the objects 50 are secured or lodged in place within the filter element 30. In some instances, some of the at least one object 50 (or plurality of objects 50) may be hollow, such as a breakable capsule, that may carry a payload incorporating a compound that is intended to introduce some change to the nature or character of mainstream smoke drawn through that filter element (e.g., a flavoring agent). That is, the shell of some hollow objects 50 may be ruptured at the discretion of the smoker to release the object payload. Alternatively, some objects 50 may be a solid, porous material with a high surface area capable of altering the smoke and/or air drawn through the filter element. Some objects may be a solid material, such as a polyethylene bead, acting as a substrate or matrix support for a flavoring agent. Some highly preferred objects are capable of releasing the agent at the command of the user. For example, a preferred breakable hollow object containing a liquid payload is resistant to the release of the payload until the time that the smoker applies a purposeful application of physical force sufficient to rupture the hollow object. Typically, a filter material, such as cellulose acetate tow, or an inserted strand, is generally absorbent of liquid materials of the type that comprise the payload, and hence the released payload components are capable of undergoing wicking (or otherwise experiencing movement or transfer) throughout the filter element. Since at least one object, and preferably a plurality of objects, is included in each filter element, the filter element may include combinations of various types of objects, as appropriate or desired.

Further, within the filter element 30 is a liquid substance 90, such as, for example, a flavoring agent (e.g., menthol), configured to affect (i.e., enhance, mix, neutralize) an attribute of the at least one object 50 disposed within the filter element 30 for altering a sensory characteristic of the smoking article 10 over the smoking article in the absence of the liquid substance. In this manner, the liquid substance 90 is intended to introduce some change to or alteration of the nature or character of mainstream smoke drawn through that filter element by interacting with and affecting an attribute of the at least one object 50.

The filter element 30 is attached to the tobacco rod 15 using tipping material 58 (e.g., essentially air impermeable tipping paper), that circumscribes both the entire length of the filter element 30 and an adjacent region of the tobacco rod 15. The inner surface of the tipping material 58 is fixedly secured to the outer surface of the plug wrap 45 and the outer surface of the wrapping material 20 of the tobacco rod, using a suitable adhesive; and hence, the filter element and the tobacco rod are connected to one another.

The tipping material 58 connecting the filter element 30 to the tobacco rod 15 can have indicia (not shown) printed thereon. For example, a band on the filter end of a cigarette (not shown) can visually indicate to a smoker the general locations or positions of the objects 50 within the filter element 30. These indicia may help the smoker to locate some objects 50 so that they can, for example, be more easily ruptured by squeezing the filter element 30 directly outside the position of any such rupturable object. The indicia on the tipping material 58 may also indicate the nature of the payload carried by each object. For example, the indicia may indicate that the particular payload is a spearmint flavoring by having a particular color, shape, or design. If desired, the inner surface (i.e., the surface facing the plug wrap) of the tipping material can be coated with a material that can act to retard the propensity of rupturable object contents from migration, wicking or bleeding from the filter material 40 into the tipping material, and hence causing what might be perceived as unsightly visible staining of the tipping material. Such a coating can be provided using a suitable film-forming agent (e.g., ethylcellulose, or a so-called lip release coating composition of the type commonly employed for cigarette manufacture).

A ventilated or air diluted smoking article can be provided with an optional air dilution mechanism, such as a series of perforations 62, each of which extend through the tipping material and plug wrap. The optional perforations 62 can be made by various techniques known to those of ordinary skill in the art, such as laser perforation techniques. As these techniques are carried out after insertion of any objects 50 into the filter element 30, care is taken to avoid damaging the objects during the formation of the perforations 62. One way to avoid damage from air dilution techniques, such as those employing laser perforation technologies, involves locating the perforations at a position adjacent to the positions of the objects 50. In such a manner, radiation, heat or physical forces acting upon the filter element during perforation processes do not have such a great propensity to damage the objects. Alternatively, so-called off-line air dilution techniques can be used (e.g., through the use of porous paper plug wrap and preperforated tipping paper). The perforated region can be positioned upstream of any object (as shown), or the perforated region can be positioned downstream of any object (i.e., towards the extreme mouth-end of the filter element).

The plug wrap 45 can vary. See, for example, U.S. Pat. No. 4,174,719 to Martin. Typically, the plug wrap is a porous or non-porous paper material. Plug wrap materials are commercially available. Exemplary plug wrap papers are available from Schweitzer-Maudit International as Porowrap Plug Wrap 17-M1, 33-M1, 45-M1, 65-M9, 95-M9, 150-M4, 260-M4 and 260-M4T. Preferred plug wrap materials are non-porous in nature. Non-porous plug wraps exhibit porosities of less than about 10 CORESTA units, and preferably less than about 5 CORESTA units. Exemplary non-porous plug wrap papers are available as Ref. No. 646 Grade from Olsany Facility (OP Paprina) of the Czech Republic (Trierendberg Holding). Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

The use of non-porous plug wrap materials is desirable in order to avoid the contents of rupturable objects within filter elements from causing what might be perceived as unsightly visible staining of the tipping material 58. For example, highly non-porous plug wrap materials can act to retard or block the propensity of liquid contents of the rupturable objects from migration, wicking or bleeding from the filter material 40 into the tipping material. The plug wrap is typically applied about the rod in a garniture region, downstream of the gathering region. As such, in some embodiments, the objects may be attached to or otherwise engaged with the plug wrap (i.e., the plug wrap comprising the elongate member). As such, when the plug wrap is applied to the rod in the garniture region, the objects may be introduced into the filter material in an alternate manner (i.e., about the periphery of the filter material, or in the form of microcapsules engaged with the plug wrap).

The dimensions of a representative cigarette 10 can vary. Preferred cigarettes are rod shaped, and can have diameters of about 7.5 mm (e.g., circumferences of about 22.5 mm to about 25 mm); and can have total lengths of about 80 mm to about 100 mm. The length of the filter element 30 can vary. Typical filter elements can have lengths of about 20 mm to about 40 mm. In one preferred embodiment, the length of the filter element 30 is about 27 mm, and the length of the tobacco rod 15 is about 56 mm to about 57 mm. In another embodiment, the length of the filter element is about 31 mm, and the length of the tobacco rod is about 67 mm to about 68 mm. The tipping paper 58 can circumscribe the entire filter element and about 4 mm of the length of the tobacco rod in the region adjacent to the filter element.

Preferred cigarettes made according to the method of the present invention exhibit desirable resistance to draw, whether or not any hollow objects within their filter elements are broken. For example, an exemplary cigarette exhibits a pressure drop of between about 50 mm and about 200 mm water pressure drop at 17.5 cc/sec. air flow. Preferred cigarettes exhibit pressure drop values of between about 70 mm and about 180 mm, more preferably between about 80 mm to about 150 mm water pressure drop at 17.5 cc/sec. air flow. Typically, pressure drop values of cigarettes are measured using a Filtrona Filter Test Station (CTS Series) available form Filtrona Instruments and Automation Ltd.

In use, the smoker lights the lighting end 28 of the cigarette 10 and draws smoke into his/her mouth through the filter element 30 at the opposite end of the cigarette. The smoker can smoke all or a portion of the cigarette with the objects 50 intact. During the portion of the smoking experience that any objects 50 remain intact, smoke generated in the tobacco rod 15 is drawn to the smoker through the filter material 40 of the filter element. In some instances, the overall character or nature of the drawn smoke may be virtually unaffected to any significant degree as a result of the presence of the intact object(s) within the filter element, unless particular objects or substances are configured to be activated by or otherwise affect the drawn smoke, such as by the liquid substance 90. If desired, the smoker may rupture any or all of the rupturable objects 50 at any time before, during, or even after, the smoking experience. Breakage of any rupturable object acts to release the contents that are contained and sealed therewithin. Release of the contents of any rupturable object into the filter element thus enables the smoker to achieve the intended benefit of action of certain of those contents, in addition to the effect initially provided by the liquid substance, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, the contents of any rupturable object are not released into the filter element until the particular object is purposefully physically broken; but when a rupturable object is ruptured, a portion of component contained within the rupturable object (e.g., portions of a flavoring agent) that is consequently released into the filter element is incorporated into each subsequent puff of mainstream smoke, in addition to the effect provided by the liquid substance, that is received through that filter element. In this manner, any rupturable object can be ruptured by the smoker at their discretion. Multiple flavors or scents in or otherwise associated with the individual objects allows for different taste in each puff of the cigarette, or an increased amplitude of sensory response in each puff may be experienced by the smoker, if the flavor is the same in all objects. In some instances, relatively small objects may be incorporated in each filter element, due to the different manners in, and the different extent to, which the sensory responses may be affected when smoking the cigarette.

During use of the cigarette, application of physical pressure to any of the rupturable objects 50, for example by a squeezing action provided by the fingers of the smoker to the filter element 30, causes relevant region of the filter element to deform and hence causes a particular rupturable object or objects to rupture and release the respective payload to the filter material 40 of the filter element. The rupture of any rupturable object 50 can be discerned by an audible pop or snap, the feel of a crushing or shattering of the rupturable object, or the sense of a rapid decrease in the resistance to the pressure applied by the smoker. Rupture of a rupturable object causes contents of its payload to disperse throughout portions of the filter material 40, and potentially to some extent into the tobacco rod 15. Most preferably, the filter element into which the objects are placed and maintained, is such that the filter element effectively maintains its overall shape during the manufacture, storage and use of the cigarette. Most preferably, the filter element is sufficiently flexible such that the overall cylindrical shape of the filter element returns to essentially its original shape after the application of pressure to the filter element is ceased. That is, the filter element possesses sufficient flexibility to allow squeezing pressure applied by the fingers of the smoker to break a rupturable object, and sufficient resilience to allow the deformed filter element to return to its original shape.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for providing a rod for use in the manufacture of cigarette filter elements, the rod having a length and defining a longitudinal axis, the apparatus comprising:

means for forming a continuous supply of filter material into a continuous rod;

means for subdividing the continuous rod, at predetermined length intervals along the longitudinal axis, into a plurality of rod portions;

means for positioning a plurality of objects within the filter material such that, upon subdivision of the continuous rod having the objects disposed therein, each rod portion includes at least one of the objects disposed therein; and means for selectively and non-continuously dispensing a liquid substance directly into the filter material, substantially commensurately with, and discretely from, positioning the objects therein, the liquid substance being configured to affect an attribute associated with the objects.

2. An apparatus according to claim 1 wherein the means for selectively dispensing a liquid substance further comprises means for metering the liquid substance into the filter material.

3. An apparatus according to claim 1 wherein the means for selectively dispensing a liquid substance further comprises means for selectively dispensing a liquid substance comprising a flavoring agent.

4. An apparatus according to claim 1 wherein the means for selectively dispensing a liquid substance further comprises:

means for receiving the liquid substance from a reservoir; and means for directing the liquid substance into the filter material.

5. An apparatus according to claim 1 further comprising means for longitudinally separating the filter material, said means for longitudinally separating being configured to extend into the path of travel of the filter material so as to separate the filter material and facilitate dispensing of the liquid substance within the filter material.

6. An apparatus according to claim 1 further comprising means for providing a continuous supply of wrapping material, wherein the apparatus further comprises garniture means for continuously applying the wrapping material about the filter material prior to the continuous rod being subdivided.

7. An apparatus according to claim 1 wherein the means for selectively dispensing a liquid substance is mounted to the means for positioning a plurality of objects.

8. An apparatus according to claim 1 wherein the means for positioning a plurality of objects is configured to define the means for selectively dispensing a liquid substance.

9. An apparatus according to claim 1 wherein the means for selectively dispensing the liquid substance into the filter material is configured to dispense the liquid substance into the filter material upstream of a position at which the means for positioning the objects within the filter material inserts the objects into the filter material.

10. A method for providing a rod for use in the manufacture of cigarette filter elements, the rod having a length and defining a longitudinal axis, the method comprising:

forming a continuous supply of filter material into a continuous rod;

subdividing the continuous rod, at predetermined length intervals along the longitudinal axis, into a plurality of rod portions;

positioning a plurality of objects within the filter material such that, upon subdivision of the continuous rod having the objects disposed therein, each rod portion includes at least one of the objects disposed therein; and selectively and non-continuously dispensing a liquid substance directly into the filter material, substantially commensurately with, and discretely from, positioning the objects therein, the liquid substance being configured to affect an attribute associated with the objects.

11. A method according to claim 10 wherein selectively dispensing a liquid substance further comprises metering the liquid substance into the filter material.

12. A method according to claim 10 wherein selectively dispensing a liquid substance further comprises selectively dispensing a liquid substance comprising a flavoring agent.

13. A method according to claim 10 wherein selectively dispensing a liquid substance further comprises:

receiving the liquid substance from a reservoir; and directing the liquid substance into the filter material.

14. A method according to claim 10 further comprising longitudinally separating the filter material along the path of travel thereof so as to facilitate dispensing of the liquid substance into the filter material.

15. A method according to claim 10 further comprising providing a continuous supply of wrapping material, and continuously applying the wrapping material about the filter material prior to the continuous rod being subdivided.

16. A method according to claim 10 wherein selectively dispensing the liquid substance into the filter material comprises dispensing the liquid substance upstream of a position at which positioning the objects within the filter material occurs.

17. An apparatus for manufacturing a rod member for a cigarette filter element, each rod member defining a longitudinal axis and including a generally longitudinally-extending filter material, the apparatus comprising:

a rod-forming unit configured to form a continuous supply of a filter material into a continuous cylindrical rod member;

an object insertion unit configured to introduce a plurality of objects into engagement with the rod member along the longitudinal axis;

a dispensing device operably engaged with the object insertion unit, the dispensing device being configured to selectively and non-continuously dispense a liquid substance directly into the filter material, substantially commensurately with, and discretely from, the introduction of the plurality of objects into engagement with the rod member, the liquid substance being configured to affect an attribute associated with the objects; and a rod-dividing unit configured to divide the rod member into a plurality of rod portions such that each rod portion includes at least one object and a portion of the liquid substance.

18. An apparatus according to claim 17 wherein the object insertion unit further comprises a rotatable insertion member configured to receive at least one of the plurality of objects and to rotate with respect to the rod member such that the at least one of the plurality of objects released from the insertion member is introduced into engagement with the rod member.

19. An apparatus according to claim 17 wherein the dispensing device is configured to meter the liquid substance into the filter material.

20. An apparatus according to claim 17 wherein the dispensing device is configured to dispense a liquid substance comprising a flavoring agent into the filter material.

21. An apparatus according to claim 17 further comprising a separating device configured to extend into the path of travel of the filter material to longitudinally separate the filter material so as to facilitate dispensing of the liquid substance into the filter material.

22. An apparatus according to claim 17 wherein the dispensing device is further configured to define at least one supply channel for dispensing the liquid substance therethrough into the filter material.

23. An apparatus according to claim 22 wherein the dispensing device is further configured to define an inlet in fluid communication with the at least one supply channel, the inlet being configured to receive the liquid substance from a reservoir.

24. An apparatus according to claim 17 further comprising a garniture unit configured to receive the rod member having the objects and the liquid substance disposed therein, and to circumscribe a longitudinal periphery of the rod member with a continuous supply of plug wrap so as to form a continuous filter rod.

25. An apparatus according to claim 17 wherein the dispensing device is mounted to the object insertion unit.

26. An apparatus according to claim 17 wherein the object insertion unit is configured to define the dispensing device.

27. An apparatus according to claim 17 wherein the dispensing device is configured to dispense the liquid substance into the filter material upstream of a position at which the object insertion unit introduces the objects into engagement with the rod member.

28. A method for manufacturing a rod member for a cigarette filter element, each rod member defining a longitudinal axis and including a generally longitudinally-extending filter material, the method comprising:

forming a continuous supply of a filter material into a continuous cylindrical rod member using a rod-forming unit;

introducing a plurality of objects into engagement with the rod member along the longitudinal axis using an object insertion unit;

selectively and non-continuously dispensing a liquid substance directly into the filter material using a dispensing device, substantially commensurately with, and discretely from, introducing the plurality of objects into engagement with the rod member, the liquid substance being configured to affect an attribute associated with the objects; and dividing the rod member into a plurality of rod portions using a rod-dividing unit such that each rod portion includes at least one object and a portion of the liquid substance.

29. A method according to claim 28 wherein introducing a plurality of objects further comprises introducing a plurality of objects into engagement with the rod member using an object insertion unit comprising a rotatable insertion member configured to receive at least one of the plurality of objects and to rotate with respect to the rod member such that the at least one of the plurality of objects released from the insertion member is introduced into engagement with the rod member.

30. A method according to claim 28 wherein selectively dispensing a liquid substance further comprises metering the liquid substance into the filter material.

31. A method according to claim 28 wherein selectively dispensing a liquid substance further comprises selectively dispensing a liquid substance comprising a flavoring agent into the filter material.

32. A method according to claim 28 further comprising longitudinally separating the filter material using a separating device configured to extend into the path of travel of the filter material, so as to facilitate dispensing of the liquid substance into the filter material.

33. A method according to claim 28 wherein selectively dispensing a liquid substance further comprises selectively dispensing a liquid substance through at least one supply channel defined by the dispensing device into the filter material.

34. A method according to claim 33 further comprising receiving the liquid substance from a reservoir, through an inlet defined by the dispensing device and in fluid communication with the at least one supply channel.

35. A method according to claim 28 further comprising receiving, in a garniture unit, the rod member having the objects and the liquid substance disposed therein, and circumscribing a longitudinal periphery of the rod member having the objects and the liquid substance disposed therein with a continuous supply of plug wrap so as to form a continuous filter rod.

36. A method according to claim 28 further comprising providing a continuous supply of wrapping material, and continuously applying the wrapping material about the filter material prior to the continuous rod being subdivided.

37. A method according to claim 28 wherein selectively dispensing the liquid substance into the filter material comprises dispensing the liquid substance upstream of a position at which introducing the objects into engagement with the rod member occurs.

* * * * *

UNITED STATES PATENT AND TRADEMARK OFFICE

CERTIFICATE OF CORRECTION

PATENT NO. : 8,308,623 B2
APPLICATION NO. : 12/259838
DATED : November 13, 2012
INVENTOR(S) : John Larkin Nelson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 835 days.

Signed and Sealed this
Twenty-sixth Day of August, 2014

Michelle K. Lee

Michelle K. Lee
*Deputy Director of the United States Patent and Trademark Office*